United States Patent [19]

Tajima

[11] 4,211,986

[45] Jul. 8, 1980

[54] STRIP LINE COUPLER HAVING SPACED GROUND PLATE FOR INCREASED COUPLING CHARACTERISTIC

[75] Inventor: Yusuke Tajima, Yokohama, Japan

[73] Assignee: Tokyo Shibaura Denki Kabushiki Kaisha, Kawasaki, Japan

[21] Appl. No.: 925,531

[22] Filed: Jul. 17, 1978

[30] Foreign Application Priority Data

Jul. 25, 1977 [JP] Japan ..... 52-89022

[51] Int. Cl.[2] ..... H01P 5/18

[52] U.S. Cl. ..... 333/116; 333/246

[58] Field of Search ..... 333/109, 115, 116

[56] References Cited

U.S. PATENT DOCUMENTS

| | | | |
|---|---|---|---|
| 3,390,356 | 6/1968 | Ryals et al. | 333/115 |
| 3,516,024 | 6/1970 | Lange | 333/116 |
| 3,560,893 | 2/1971 | Wen | 333/116 X |
| 3,659,228 | 4/1972 | Napoli | 333/116 |
| 3,904,997 | 9/1975 | Stinehelfer, Sr. | 333/116 |

OTHER PUBLICATIONS

Lange, *Interdigitated Stripline Quadrature Hybrid,* G-MTT Int'l. Microwave Symposium, pp. 10-13.

Cristal, *Theory & Tables of . . . Directional Couplers,* IEEE Trans. on MTT, 9-65, pp. 544-558.

Schneider et al., *Microwave & Mollimeter . . . Circuits for Radio Systems,* BSTJ, Jul.-Aug. 1969, pp. 1702-1726.

*Primary Examiner*—Paul L. Gensler

*Attorney, Agent, or Firm*—Oblon, Fisher, Spivak, McClelland & Maier

[57] ABSTRACT

Disclosed is a strip line coupling circuit which comprises a dielectric plate, two strip line conductors arranged on one surface of the dielectric plate facing each other with one portion closer than others, and a grounding conductor formed on and over the other surface of the dielectric plate.

In such strip line coupling circuit of this invention, the grounding conductor is disposed with a vacant space between itself and the dielectric plate at a position corresponding to the portion where the two strip line conductors are arranged closer to each other.

7 Claims, 13 Drawing Figures

STRIP LINE COUPLER HAVING SPACED GROUND PLATE FOR INCREASED COUPLING CHARACTERISTIC

BACKGROUND OF THE INVENTION

This invention relates to a strip line coupling circuit having a strong coupling characteristic over a wide band.

Heretofore, a variety of microwave strip line coupling circuits have been proposed and used. For example, there is known a strip line coupling circuit, as shown in FIG. 1, which is provided with three distributed-coupling type directional couplers 1, 2 and 3 each as long as ¼ of the wavelength of a microwave used at the center frequency, formed of two microwave strip lines. In order to form a 3 dB coupling circuit with such a good frequency characteristic as shown in FIG. 2 from that strip line coupling circuit, however, it is required that the degree of coupling of the directional coupler 2, which is supposed to have the highest one, should be set at 1.6 to 1.7 dB. It is very difficult to provide such strong coupling by bringing both those strip line conductors close to each other.

SUMMARY OF THE INVENTION

The object of this invention is to provide a strip line coupling circuit with simple construction exhibiting a high degree of coupling over an extensive band.

According to an embodiment of the invention, there is provided a strip line coupling circuit comprising a dielectric plate, a coupling means formed of a plurality of strip lines arranged on one surface of the dielectric plate opposite to one another and including loose and tight coupling sections, and a ground conductor formed on the other surface of the dielectric plate with space between the ground conductor and the surface region of the dielectric plate at a portion where the tight coupling section is formed.

DETAILED DESCRIPTION OF THE PREFERRED EMBODIMENTS

Figure 3:
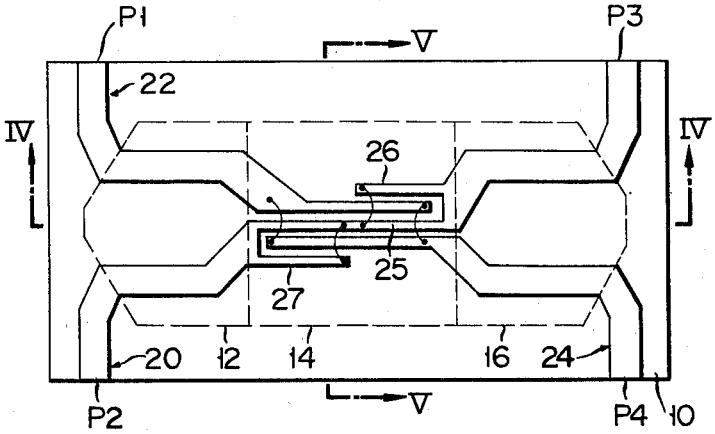
FIG. 3 is a top view of a strip line coupling circuit according to an embodiment of this invention.
Figure 5:
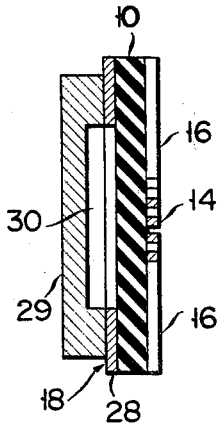
FIG. 5 is a sectional view of the strip line coupling circuit as taken along line V—V of FIG. 3.
Figure 4:
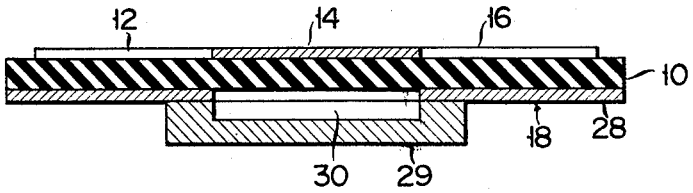
FIG. 4 is a sectional view of the strip line coupling circuit as taken along line IV—IV of FIG. 3.

Referring to FIGS. 3 to 5, there is shown a strip line coupling circuit formed as a directional coupler according to an embodiment of this invention. The directional coupler is provided with a dielectric plate 10 formed of aluminum, for example, and first, second and third coupling sections 12, 14 and 16 each with an effective length equal to ¼ of the wavelength of a microwave used at the center frequency thereof which are formed on the top of the dielectric plate 10, and a ground conductor 18 formed on the opposite surface of the dielectric plate 10. The first, second and third coupling sections are composed of three strip lines 20, 22 and 24 which are made up by forming a metal layer on the dielectric plate 10 by vacuum evaporation or plating with gold or some other metal and then selectively removing part of the metal layer by photoetching or the like. The first coupling section 12 is formed of the central portion of the strip line 22 with one end coupled to a port P1 and that part of the strip line 20 coupled between ports P2 and P3, and facing the central portion of the strip line 22, while the third coupling section 16 is formed of the central portion of the strip line 24 with one end coupled to a port P4 and that of the strip line 20 facing the central portion of the strip line 24. Further, the central portion of the strip line 20, which includes a center line section 25, first and second branch line sections 26 and 27, forms the coupling section 14 with interdigital construction in conjunction with the end portions of the strip lines 22 and 24. In the coupling section 14, wire bonds are formed between the center line section 25 and each of the first and second branch line sections 26 and 27 as well as between the two strip lines 22 and 24 by a well-known technique, as shown in FIG. 3. Consisting of line sections arranged in close vicinity to one another, the central coupling section 14 has a higher degree of coupling as compared with the coupling sections 12 and 16 on each side.

Meanwhile, the ground conductor 18 formed on the opposite surface of the dielectric plate 10 includes a first conductor layer 28 formed on the plate 10 except a portion opposite to the coupling section 14 and a second conductor layer 29 formed at the portion opposite to the coupling section 14 with space 30 between itself and the dielectric plate 10. The first conductor layer 28 may be formed by, for example, treating the whole area of the other surface of the dielectric plate 10 with gold or other conductive material by vacuum evaporation or coating, and then removing the resultant metal layer at the portion opposite to the coupling section 14. On the other hand, the second conductor layer 29 may be formed by setting a boxlike conductor having a recess with the length equal to e.g. ¼ wavelength, the width larger than the distance between the branch line sections 26 and 27 of the strip line 20, and the depth of approximately 0.2 mm on the dielectric plate 10 so as to cover up the removed portion of the first conductor layer 28.

Figure 6:
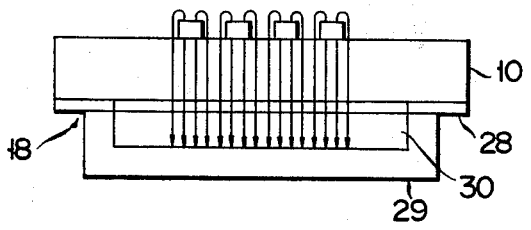
FIGS. 6 and 7 are schematic views of the strip line coupling circuit as shown in FIGS. 3 to 5 showing the electromagnetic field distribution in even and odd modes of the strong coupling central section, respectively.
Figure 7:
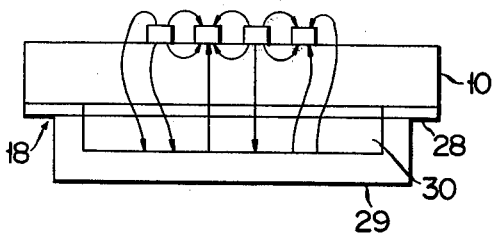

In such strip line coupling circuit as described above, the coupling section 14 is of suspended construction with the space 30, that is, the coupling section 14 has space formed between the ground conductor 29 and dielectric plate 10. FIGS. 6 and 7 show the even and odd modes of coupling of the strip line conductors 20, 22 and 24 at the coupling section 14, respectively. The electromagnetic field in the even mode is intensively distributed within the region of the dielectric plate 10, whereas that in the odd mode is subject to a substantial leakage. Consequently, the difference in the coupling impedance of the coupling section between the odd and even modes becomes greater, thereby increasing the degree of coupling between the strip lines 20, 22 and 24.

Figure 8:
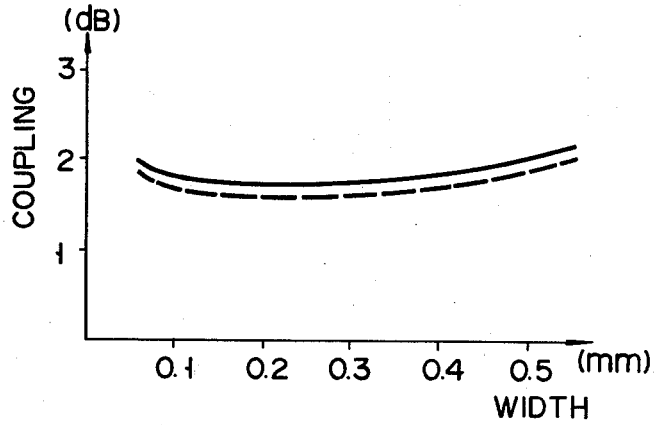
FIG. 8 illustrates the relation between the width of a strip line conductor forming the strong coupling central section and the degree of coupling of such coupling section.

FIG. 8 shows the relation between the degree of coupling between the strip line conductors 20, 22 and 24 of the coupling section 14 and the width of the strip line conductors 20, 22 and 24 at the coupling section 14. Here, an aluminium plate with a thickness of 0.635 mm and a dielectric constant of 10.5 is used for the dielectric plate 10, each distance between the strip line conductors 22 and 24 and the line sections 25, 26 and 27 of the strip line conductor 20 at the coupling section 14 is 0.05 mm, and the depth of the space 30 is 0.20 mm (solid line) or 0.25 mm (broken line). As may be seen from the coupling characteristic as shown in FIG. 8, there may be obtained a degree of coupling as high as approximately 1.6 dB at the coupling section 14.

Figure 9:
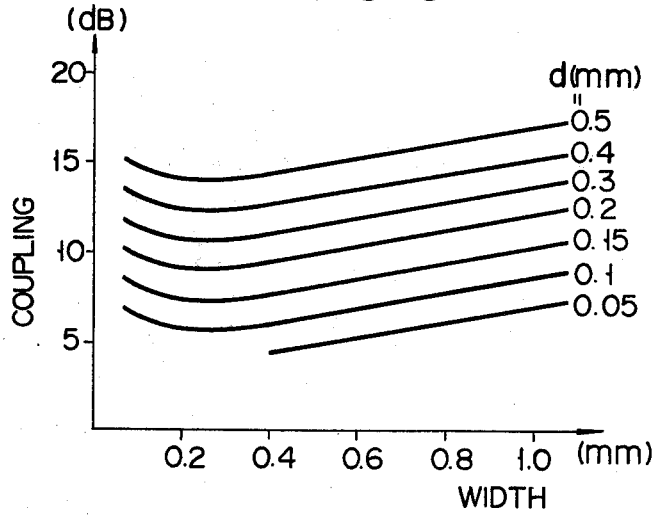
FIG. 9 illustrates the relation between the width of a strip line conductor forming the weak coupling end section and the degree of coupling of such coupling section.

Unlike the coupling section 14, the coupling sections 12 and 16 are of the conventional microwave strip line construction which is suitable for attainment of a lower degree of coupling. In FIG. 9, there is shown the relation between each degree of coupling between the strip line conductor 20 and the strip line conductor 22 or 24 at the coupling section 12 or 16 and the width of these strip line conductors 20, 22 and 24, with the distance d between the strip line conductor 22 or 24 given as a parameter. Here the same material as the case of FIG. 8 is used for the dielectric plate 10.

Figure 10:
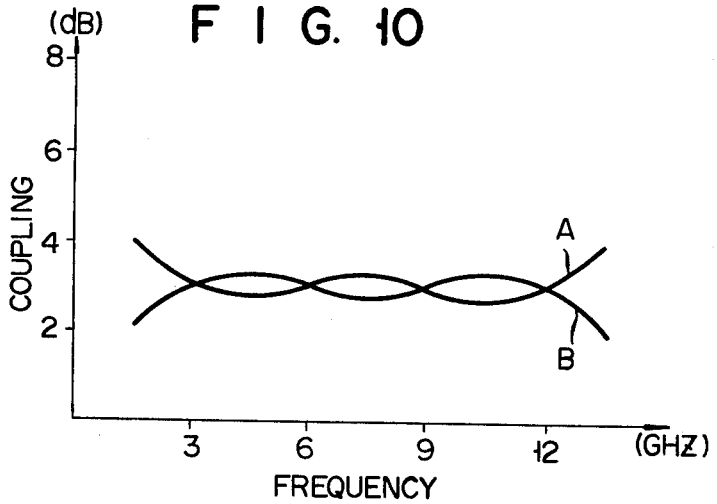
FIG. 10 shows coupling-frequency characteristic curves of the strip line coupling circuit shown in FIGS. 3 to 5.

Employing the strip line coupling circuit as shown in FIGS. 3 to 5, a close coupling of approximately 3dB may be obtained for the whole body of the circuit, as shown in FIG. 10, by setting at 16dB each degree of coupling of the strip line conductor 20 and the strip line conductors 22 and 24 at the coupling sections 12 and 16 and the degree of coupling at the coupling section 14 at 1.6dB. Moreover, such coupling characteristic is indicative of a stagger characteristic, so that the degree of coupling at 3dB may be obtained over a wide range of frequency. In FIG. 10, curves A and B indicate the microwave propagation characteristics from the port P2 to P3 and from the port P2 to P1, respectively. As is clear from FIG. 10, microwave power is transmitted from the port P2 to the port P1 or P3 at a quite suitable rate over a wide band ranging from 3 to 12 GHz.

Thus, by coupling the weak coupling sections 12 and 16 with the strong coupling section 14 in cascade fashion, there may be obtained a coupling circuit exhibiting a relatively high degree of coupling over a wide band.

Figure 1:
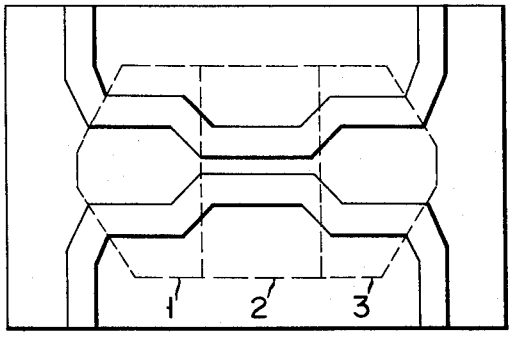
FIG. 1 PRIOR ART
FIG. 1 is a top view of a prior art three-stage microwave strip line coupling circuit.
Figure 2:
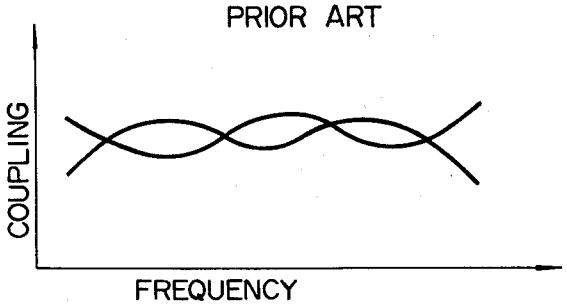
FIG. 2 PRIOR ART
FIG. 2 shows coupling-frequency characteristic curves of the strip line coupling circuit of FIG. 1.
Figure 11:
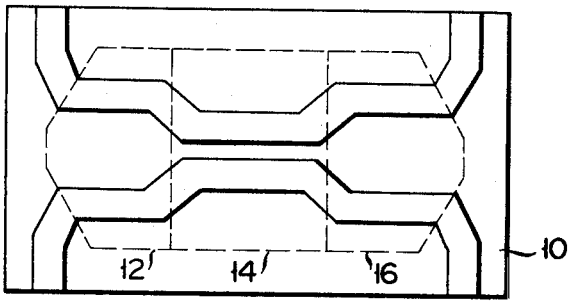
FIGS. 11 to 13 are the respective top plan views of the strip line coupling circuits according to alternative embodiments of the invention.
Figure 12:
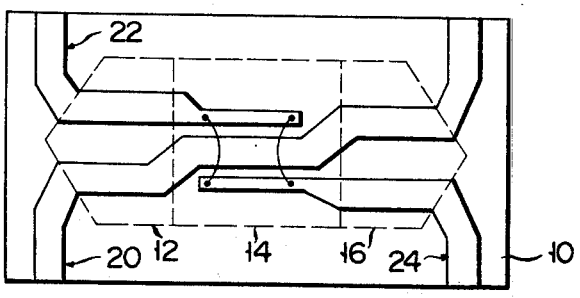
Figure 13:
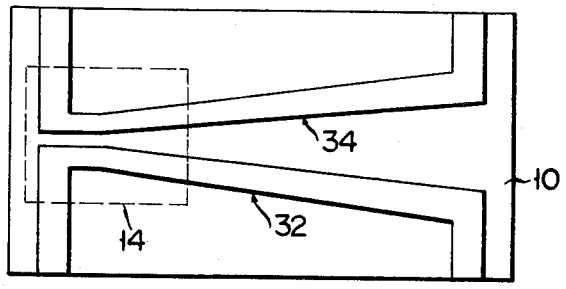

Although an embodiment of this invention has been described in detail herein, it is to be understood that the invention is not limited to that precise embodiment, and that the coupling circuit may be of any type so long as it includes a weak coupling section cascade-connected with a strong coupling section which is formed to have space between the ground conductor and the dielectric plate. For example, the same coupling characteristic as shown in FIG. 10 may be obtained from a coupling circuit, as shown in FIG. 11, with strip lines similar to those of the prior art coupling circuit as shown in FIG. 1 formed on the top of the dielectric plate 10 as well as with the strong coupling section 14 to have space between the ground conductor and the dielectric plate. Moreover, the coupling section 14 has interdigital construction as in FIG. 3, though the strip line conductors 20, 22 and 24 at the coupling section 14 may be arranged in parallel with one another, the strip line conductors 22 and 24 being coupled by means of bonding wires, as shown in FIG. 12. Although the degree of coupling between the strip line conductors is changed stage by stage in the above-mentioned embodiments, two strip line conductors 32 and 34 may be opposed to each other over, for example, an effective length equal to $\frac{3}{4}$ wavelength so as gradually to draw closer to each other, thus forming the coupling section 14 with a length equal to $\frac{1}{4}$ wavelength at a portion where those conductors 32 and 34 are nearest to each other, as shown in FIG. 13. In this case, a ground conductor is formed on the back side of the dielectric plate 10 so that the coupling section 14 may have space formed between the ground conductor and the dielectric plate 10.

What is claimed is:

1. A strip line coupling circuit comprising:

a dielectric plate having first and second planar surfaces opposite to each other;

coupling means formed of a plurality of strip line conductors arranged on said first planar surface of said dielectric plate and including strong and weak coupling sections connected with one another; and a ground conductor formed on said second planar surface of said dielectric plate, that portion of said ground conductor which faces said strong coupling section being separated from said second planar surface of said dielectric plate by a predetermined distance to lower the dielectric constant and thereby increase the coupling capacity of said strong coupling section over said weak coupling section, and the remaining portion of said ground conductor being attached to the second planar surface of said dielectric plate.

2. A strip line coupling circuit according to claim 1, wherein each of said strong and weak coupling sections has a length substantially equal to a multiple of the quarter wavelength at the center frequency of an electromagnetic wave used.

3. A strip line coupling circuit according to claim 1 or 2, wherein said coupling means is formed of two strip line conductors facing each other and arranged closer to each other in one area of said first planar surface of said dielectric plate to form said strong coupling section that in the other area of said first planar surface to form said weak coupling section.

4. A strip line coupling circuit according to claim 3, wherein said weak coupling section has first and second weak coupling portions with a length equal to a multiple of the quarter wavelength of the microwave used, said first and second coupling portions of said weak coupling section being cascade-connected to said strong coupling section to thereby increase coupling over a wide band.

5. A strip line coupling circuit according to claim 1 or 2, wherein said coupling means is formed of two strip line conductors facing each other and arranged gradually to approach each other from first facing end portion to second facing end portion, said two strip line conductors forming said strong coupling section at the closest portion and weak coupling section at the other portion.

6. A strip line coupling circuit according to claim 1 or 2, wherein said coupling means includes a first strip line having first, second and third line sections, a second strip line facing said first and second line sections of said first strip line and disposed closer to said second line section than to said first line section, and a third strip line facing said second and third line sections of said first strip line on the opposite side of said second strip line with respect to said first strip line and disposed closer to said second line section than to said third line section, said second and third strip lines being electrically connected with each other at portions where each of said second and third strip lines faces said second line section of said first strip line.

7. A strip line coupling circuit according to claim 6, wherein said second line section of said first strip line and said second and third strip lines form an interdigital construction in conjunction with one another at a portion where said second line section faces each of said second and third strip lines.

* * * * *